United States Patent [19]

Cuffaro

[11] Patent Number: 4,899,683

[45] Date of Patent: Feb. 13, 1990

[54] OCCUPANCY MARKER

[76] Inventor: Antonino Cuffaro, 27 Lipstan Avenue, Nepean, Ontario, Canada, K2E 5Z2

[21] Appl. No.: 135,711

[22] Filed: Dec. 21, 1987

[30] Foreign Application Priority Data

Jan. 28, 1987 [CA] Canada ..... 528207

[51] Int. Cl.[4] ..... G08B 5/00

[52] U.S. Cl. ..... 116/215

[58] Field of Search ..... 40/459, 460, 492, 907; 116/85, 86, 100, 215, 319, 313; 232/34, 35, 37

[56] References Cited

U.S. PATENT DOCUMENTS

| | | | |
|---|---|---|---|
| 605,837 | 6/1898 | Avery | 116/215 |
| 823,782 | 6/1906 | Holden | 116/215 |
| 1,415,005 | 5/1922 | Klausmeyer | 116/215 |
| 2,269,902 | 1/1942 | Clark | 116/215 |
| 2,498,260 | 2/1950 | Fabis | 232/34 |
| 2,609,787 | 9/1952 | Lawson | 232/35 |
| 3,747,839 | 7/1973 | Morton | 232/35 |
| 3,891,139 | 6/1975 | Redling | 232/35 |
| 4,437,607 | 3/1984 | Negosta | 232/35 |
| 4,708,286 | 11/1987 | Norris | 232/35 |
| 4,752,030 | 6/1988 | Witt | 232/35 |

FOREIGN PATENT DOCUMENTS

| | | | |
|---|---|---|---|
| 963505 | 2/1975 | Canada . | |
| 1230787 | 12/1987 | Canada . | |
| 8375 | 4/1909 | United Kingdom | 116/319 |

*Primary Examiner*—William A. Cuclinski, Jr.
*Assistant Examiner*—W. Morris Worth
*Attorney, Agent, or Firm*—Arnold, White & Durkee

[57] ABSTRACT

A safety device for use in indicating whether a closure member, such as a door or window, disposed in a frame defining an opening in a room of an edifice, has been opened, comprises an elongated, unitary, relatively thin planar stationary member secured to a face of the closure member adjacent the frame at an angle to the horizontal, the stationary member having one end disposed adjacent the frame and an other end remote from the frame with the one end being at a higher elevation than the other end and an elongated, unitary, relatively thin planar movable member pivotally secured to the first member adjacent the other end of the stationary member for pivotal movement about an axis extending substantially at right angles to the planes of the first and second members, the movable member having a rounded edge remote from the one end thereof and is of a length such that the edge abuttingly engages and is partially supported by the frame, the movable member being movable under the influence of gravity from a first position whereat the movable member completely conceals the stationary member from view and the edge means engages the frame when the closure member is closed to a second position when the closure member is opened whereat the movable member exposes the first member to view and wherein the stationary and movable members are of different colors.

12 Claims, 1 Drawing Sheet

OCCUPANCY MARKER

The present invention relates to a safety device for use in indicating whether a closure member such as a door or window has been opened and closed and, more specifically, whether a resident or patient in an institution has left his or her room.

BACKGROUND OF THE INVENTION

It is customary for institutions such as Senior Citizens' Residences, Nursing Homes, Hospitals, Day Care Centers and the like to require that all patients or residents be in designated areas or rooms at designated times so as to facilitate attendant staff's responsibility of quickly accounting for all patients and/or residents. It is not infrequent for some patients or residents to leave their designated areas and for their absence to go unnoticed for some time. This may, in some circumstances, have serious repercussions, such as loss of life, heart attack, fire, falling, loss of memory, fear and Wandering.

A variety of electronic devices specifically adapted for monitoring the absence or presence of a person at a specific location have been developed are presently available in the marketplace. Such devices are not only expensive, but are ineffective during power failures and/or shortages and, otherwise, are subject to malfunction. Indeed, it may be during such power failures that a patient monitoring device is most necessary.

SUMMARY OF THE INVENTION

The primary object of the present invention is to provide an effective, inexpensive, easily installed and operated device for indicating the presence in or absence from a designated areas or rooms of patients or residents. The invention is particularly concerned with patients who tend to be absent minded and are unable to care for themselves.

Broadly, the present invention provides a safety device for use in indicating whether a closure member, such as a door or window, of a room of an edifice has been opened, the device comprising a first member adapted to be secured to the closure member and a second member secured to the first member for movement from a first position thereat the second member conceals the first member from view to a second position in which the second member exposes the first member to view in response to opening of the closure member.

In use, after escorting a patient to his designated area, the attendant closes the door on the way out and places the second member in its set position overlying the first member and obscuring it from view. If for some reason, the occupant of the area opens the door, the second member will lose its support and will drop to its second position, thereby exposing the first member.

In a busy institution, the attendant responsible for the patient will be alerted to any change by observing the state or position of the second member and will then take the necessary measures.

This can be made even more prominent by making the first and second members of different colours so that when in view, the colour of the first member will be an immediate indication that the patient s room should be checked. If on the other hand, the colour of the first member is not visible, the attendant can be reasonably certain that the patient has not left his room.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
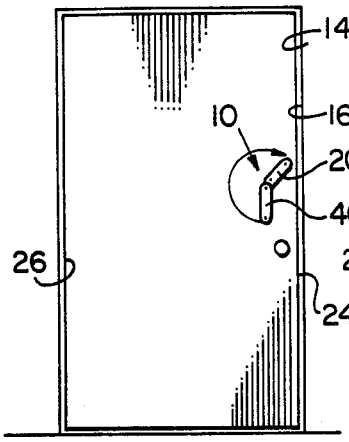
FIG. 1 is a front elevational view of an access way which opens to the interior of a room in a building and illustrating the preferred embodiment secured to the door thereat.
Figure 2:
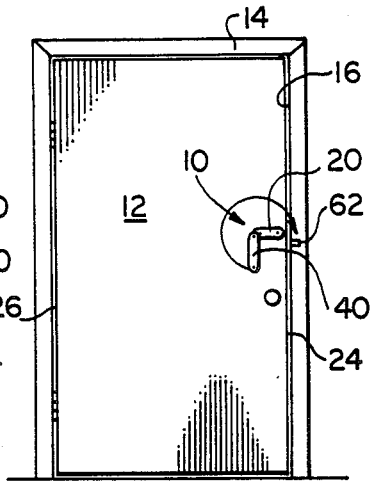
FIG. 2 is a front elevational view of an access way which opens to the exterior or outwardly of a room in a building and illustrating a preferred embodiment secured to the door thereat.

With reference to FIG. 1 and 2, the safety device 10 will be seen to be affixed to the exterior surface of a door 12 hingedly secured disposed to a door frame 14, in conventional fashion, defining an opening 16 in a room of an edifice. Device 10 is comprised of an elongated, unitary, relatively thin planar stationary member 20 and an elongated, unitary, relatively thin planar movable member 40.

Figure 3:
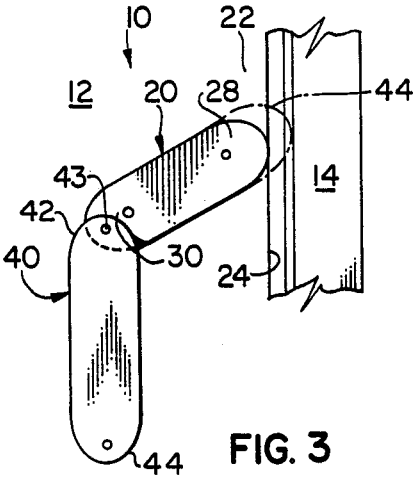
FIG. 3 is an enlarged elevational view of the preferred embodiment used in conjunction with the access illustrated in FIG. 1.

With particular reference to FIG. 1 and 3 in which there is illustrated a device adapted to be used with a door which opens inwardly of a room, stationary member 20 is adapted to be secured by any suitable means, such as screws, adhesives or the like, to exterior face 22 of the door adjacent the vertical edge 24 of the door remote from vertical hinge edge 26 of the door. The stationary member is disposed at an angle to the horizontal, for reasons which become clear hereinbelow, such that one end 28 thereof is disposed adjacent edge 24 of the door and an other end 30 is remote from edge 24 with end 28 being at a higher elevation than edge 30.

One end 42 of movable member 40 is pivotally secured, by a pivot pin 43, which may be in the form of a screw, rivet or the like, to stationary member 20 adjacent end 30 of the stationary member for pivotal movement about an axis which extends substantially at right angles to the planes of the stationary and movable members. Movable member 40 is formed with a rounded edge 44 remote from end 42 thereof and is of a length such that edge 44 abuttingly engages and is partially supported by the door frame when the door is closed. The movable member is movable, under the influence of gravity, from a first position to a second position when the door is opened. The first position, which will hereinafter be referred to a the set position, is shown in dotted and dashed lines in FIG. 3. In this position, the movable member overlies and completely conceals the stationary member from view and edge 44 engages the door frame when the door is closed. The second position, hereinafter referred to as the unset position, is shown in solid lines in FIG. 3. The second member moves to this position when the door is opened and exposes the stationary member to view.

In use, after escorting a patient to his designated area, the attendant closes the door on the way out and places the movable member in its set position overlying the stationary member and obscuring it from view. If for some reason, the occupant of the area opens the door, the movable member will lose its support on the door frame and will drop to its movable position, thereby exposing the stationary member. In a busY institution, the attendant responsible for the patient will be alerted to any change by observing the state or position of the movable member and will then take the necessary measures.

This can be made even more prominent by making the stationary and movable members of different and contrasting colours so that, when in view, the colour of the stationary member will be an immediate indication that the patient's room should be checked. If on the other hand, the colour of the stationary member is not visible, the attendant can be reasonably certain that the patient has not left his room. For example, the stationary member may be red and the movable member may be white or the same colour as the door. However, any other colour scheme could be employed.

The members may be of any desired shape, although the elongated shape with rounded ends illustrated in the drawings, is preferred, and may be constructed of any suitable material such as plastic, metal, wood, paperboard or any combination of these.

The invention is designed to be installed at one side of a panel that denotes entrY to an area, for example doors, windows, gates, or any opening, or a door, and it would be installed in such a way that the stationary member is fastened at an angle, with its free edge even to the edge of the door and the movable member extending beyond the edge of the door.

Figure 4:
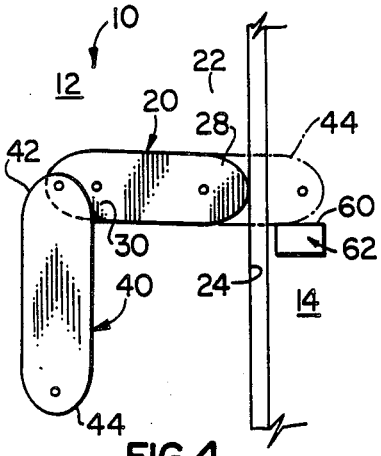
FIG. 4 is an enlarged elevational view of a preferred embodiment used in conjunction with the access illustrated in FIG. 2.

The versatility of the device is such that it can be installed in an access that opens inwardly, as explained above, or outwardly as shown in FIGS. 2 and 4 and explained hereinbelow. In an access which opens outwardly, the stationary member is installed horizontally with its free edge flush with the edge of the access door, and the movable member, in its set position, will rest in a shoulder or surface 60 provided by a support 62 fastened to the front face of the door frame. In this manner, it will be understood that when the access door is opened outwardly, the movable member will be pushed off of the support and rotate to its unset position thus exposing the underlying stationary member.

it will be understood that various modifications and alterations may be made to the above described invention without departing from the spirit of the appended claims.

The embodiments of the invention in which an exclusive property or privilege is claimed are defined as follows:

1. A safety device to indicate whether a closure member, such as a door or window, in a framed opening of a room of an edifice has been opened, said device comprising:

a first member for securement to said closure member; and a second member pivotally secured to said first member for pivotal movement about a pivot means having an axis extending substantially at right angles to the planes of said first and second members, said second member being movable by gravity from a first position to a second position, said second member having edge means engageable in said first position with the frame of the opening; whereat said second member conceals said first member from view in said first position and exposes said first member to view in response to opening of said closure member sufficiently for said second member to clear the frame and move to said second position.

2. A safety device to indicate whether a closure member, such as a door or window, disposed in a framed opening of a room of an edifice, has been opened, said device comprising:

an elongated, unitary, relatively thin, planar, stationary, first member for securement to a face of said closure member adjacent the frame of a room opening at an angle to the horizontal, said first member having one end disposed adjacent the frame and an other end remote from the frame, said one end being at a higher elevation than said other end;

an elongated, unitary, relatively thin, planar, movable, second member having one end disposed adjacent the frame and an other end pivotally secured to said first member adjacent said other end of said first member for pivotal movement about a pivot means having an axis extending substantially at right angles to the planes of said first and second members, said second member having rounded edge means at said one end thereof, and being of a length such that said edge means abuttingly engages and is partially supported by the frame, said second member being movable under the influence of gravity from a first position whereat said second member completely conceals said first member from view and said edge means engages said frame when said closure member is closed, to a second position upon the opening of said closure member sufficiently for said second member to clear the frame whereat said second member moves to said second position and exposes said first member to view.

3. A safety device as defined in claim 1, wherein said first and second members are planar.

4. A safety device as defined in claim 1, wherein each said first and second members are unitary, relatively thin, planar members.

5. A safety device as defined in claim 1, wherein said edge means is curved.

6. A safety device as defined in claim 3, wherein said edge means is curved.

7. A safety device as defined in claim 4, wherein said edge means is curved.

8. A safety device as defined in claim 1, wherein said first and second members are of different colours.

9. A safety device as defined in claim 2, wherein said first and second members are of different colours.

10. A safety device as defined in claim 3, wherein said first and second members are of different colours.

11. A safety device as defined in claim 4, wherein said first and second members are of different colours.

12. A safety device as defined in claim 5, wherein said first and second members are of different colours.

* * * * *